United States Patent [19]

Diener et al.

[11] 4,335,870

[45] Jun. 22, 1982

[54] COOLING ELEMENT FOR USE IN METALLURGICAL FURNACES

[75] Inventors: Arnulf Diener, Dortmund; Walter Laucht, Hagen; Eugen Icking, Witten, all of Fed. Rep. of Germany

[73] Assignee: Hoesch Werke Aktiengesellschaft, Dortmund, Fed. Rep. of Germany

[21] Appl. No.: 101,226

[22] Filed: Dec. 7, 1979

[30] Foreign Application Priority Data

Jan. 27, 1979 [DE] Fed. Rep. of Germany ..... 2903104

[51] Int. Cl.[3] ..... F27B 1/24

[52] U.S. Cl. ..... 266/193; 122/6 B; 164/107; 165/168; 432/238

[58] Field of Search ..... 266/193, 194, 241; 122/6 B; 165/168

[56] References Cited

U.S. PATENT DOCUMENTS

| | | | |
|---|---|---|---|
| 3,690,633 | 9/1972 | Andonier et al. | 266/193 |
| 3,706,343 | 12/1972 | Saiga et al. | 266/193 |
| 4,121,809 | 10/1978 | Dhelft | 266/193 |

OTHER PUBLICATIONS

The Making, Shaping & Treating of Steel, U.S. Steel, 1964, p. 1007.

*Primary Examiner*—M. J. Andrews
*Attorney, Agent, or Firm*—Max Fogiel

[57] ABSTRACT

A cooling element for use in metallurgical furnaces, such as blast furnaces, and a method of making the same. The cooling element is composed of a cast-steel body having a surface which in use faces the interior of the respective furnace and which is provided with elements of refractory material. Embedded in the cast-steel body are steel tubes through which cooling medium is to be circulated when the element is in use. Embedded between the respective tubes are heat-absorbing members which are preferably of the same or an analogous material as the cast-steel body itself and which have the purpose of absorbing the temperature differential between the liquidous point of the steel melt and the superheated temperature at which the melt is cast.

7 Claims, 2 Drawing Figures

COOLING ELEMENT FOR USE IN METALLURGICAL FURNACES

BACKGROUND OF THE INVENTION

The present invention relates to a cooling element for use in a metallurgical furnace, particularly in a blast furnace.

The invention also relates to a method of making a cooling element of the type outlined above.

It is already known to install cooling elements of various different types in the walls of metallurgical furnaces, such as blast furnaces, in order to protect these walls against damage resulting from the high temperatures—and temperature fluctuations—occurring in operation of such furnaces. In recent years a type of cooling element has become popular, particularly for use in blast furnaces, which is known as a "plate cooler" or "stave cooler". This type of cooling element is composed of a cast-iron body in which steel tubes are embedded, and cooling medium—usually water, steam or a watersteam mixture—is circulated through these tubes. The surface of the cooling element which faces inwardly towards the furnace chamber is provided with recesses in which refractory materials are installed, for example like casting or bonding. Constructions of this type are disclosed in German Gebrauchsmuster No. 7,331,936 and in German Pat. No. 1,925,478.

This type of cooling element is basically quite satisfactory. However, the actual body of the cooling element heretofore has always been made of cast iron and more specifically of grey cast iron with differing graphite structure. This is disclosed, for example, in German Allowed Application AS No. 2,719,165.

The use of grey cast iron, however, represents a problem because the working temperature in such metallurgical furnaces is usually close to the melting point of the grey cast iron. Accordingly, it is often found—when such cooling elements are removed from the furnace—that the body of grey cast iron is partly melted. In addition to this, it is well known that even at temperatures as low as about 100° C. below the melting point of such materials as grey cast iron, the technological characteristics of these materials are very poor. When such cooling elements of grey cast iron are used in metallurgical furnaces, and particularly in blast furnaces, it has accordingly been observed again and again that they exhibit signs of destruction at their side which faces inwardly toward the chamber of the furnace.

SUMMARY OF THE INVENTION

Accordingly, it is a general object of this invention to overcome the disadvantages of the prior art.

More particularly, it is an object of the present invention to provide an improved cooling element of the type outlined, for use in such metallurgical furnaces as blast furnaces and others, which is subject to only very little wear, is inexpensive to produce and exhibits a much increased service life.

An additional object of the invention is to provide a method of making such a cooling element.

Pursuant to these objects, and to still others which will become apparent hereafter, one aspect of the invention resides in a cooling element for use in metallurgical furnaces particularly for use in blast furnaces. Briefly stated, such a cooling element may comprise a body of steel cast at a temperature above the liquidous point and having a surface adapted to face inwardly of the furnace; a plurality of steel tubes embedded in said body and adapted to have cooling fluid circulated through them; and means embedded in said body spaced from said steel tubes and operative for absorbing, during the casting of said body, the temperature differential which exists between the casting temperature and the liquidous point of the steel.

The means for absorbing this temperature differential are preferably members of steel or cast steel, and it is advantageous if these members are of the same material as the material of which the cooling element body itself is cast. A particularly effective and intimate connection between the cast steel body and the members embedded in it is obtained if the volume of these members, which are placed or suspended in the casting form for the body, amounts to between 1/20 and 1/10 of the volume of the cast body itself.

The elements may be in the form of bars having quadratic or rectangular cross section and advantageously extend parallel to the cooling tubes which are also embedded in the cast steel body.

A currently preferred method of making the aforementioned cooling element may, briefly stated, comprising the steps of arranging a plurality of steel cooling tubes at positions which they are to assume in the finished cooling element; arranging a plurality of heat-absorbing members spaced from the aforementioned tubes; and casting about the tubes and members a steel melt having a temperature in excess of the liquidous point of the steel, so as to embed the tubes and bodies in the melt and form a unitary cooling element therewith.

The cooling element will, of course, be provided on its side which subsequently is to face the interior chamber of a furnace, with the usual cladding of refractory material. For this purpose this surface may be provided with recesses extending parallel to the broad side of the cooling element and in which the refractory material may be anchored.

According to a preferred embodiment of the method, the steel melt used to cast the body of the cooling element is cast within a time period smaller than three minutes and at a super heated temperature of about 30°–80° C. above the liquidous temperature of the steel. It is advantageous if the steel melt has a composition of 0.15 to 0.50% C
0.30 to 0.80% Si
0.50 to 2.00% Mn
max 1.00% Mo
max 2.50% Cr
max 0.1% Al the remainder being iron and unavoidable contaminents. The temperature-absorbent bodies are preferably of a material of a character similar to that of the melt used for casting the body of the cooling element. The preferred carbon content of the material used for these members should differ from the carbon content of the steel melt respectively the cast-steel melt by not more than 0.2%, the content of manganese by not more than 0.5% from that of the melt, and the content of silicon by not more than 0.50%. It is preferable if the content of CMn and Si of these elements is below the content of the similar components of the melt for the cast-steel body.

It has also been found to be advantageous, in terms of the method according to the present invention, if the steel cooling tubes being embedded in the body of cast steel are filled prior to the casting of the steel with a particulate material having a high melting point and a high coefficient of thermal conductivity. Particularly advantageous materials for this purpose are zirconium oxide, chromium oxide or a mixture containing more than 20% of these oxides. After the steel casting has rigidified, this particulate material is then removed again from the steel tubes.

The invention will hereafter be described with respect to an embodiment as illustrated in the appended drawings. However, it is to be understood that this is merely for purposes of explanation and not to be considered limiting in any sense. The definition of the aspect of the invention for which protection is sought is to be found exclusively in the appended claims.

DESCRIPTION OF THE PREFERRED EMBODIMENTS

Figure 1:
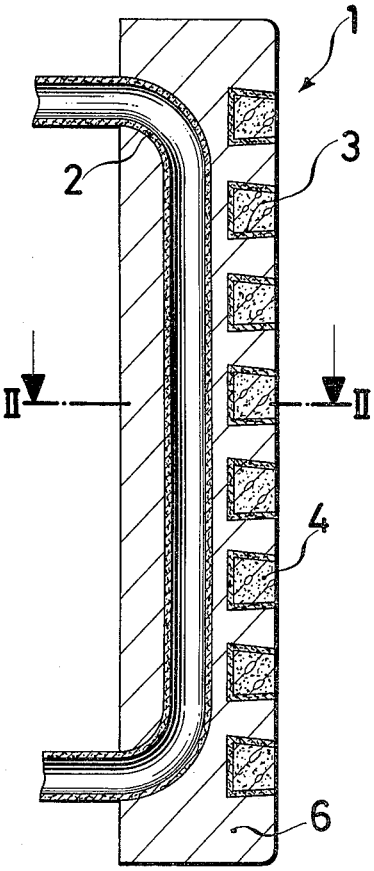
FIG. 1 is a longitudinal section through a cooling element according to the present invention.

The invention will hereafter be described with reference to FIGS. 1 and 2 of the drawing, conjointly both as to its method aspects and as to the novel article itself.

With this in mind it will be understood that the method must be carried out by effecting the casting in a casting form which, for the sake of simplicity, has not been illustrated. However, it is clear that the casting form must have a mold cavity corresponding to the configuration of the article to be cast, i.e. to the article shown in FIG. 1. This article, namely the cooling element per se, is identified with reference numeral 1 in the drawing. To produce it, steel tubes 2 (any desired number) are positioned in or suspended in the casting mold and filled with one of the aforementioned particulate materials, for example with particulate chromium ore. The purpose of filling the tubes with one of these materials, or with a mix of these materials, is that these materials have a high coefficient of thermal conductivity. The casting mold is so constructed that during casting of the element 1 that side thereof which after installation in a metallurgical furnace will face the interior of the furnace chamber, will become formed with recesses 3 into which, subsequent to the casting and rigidification, bodies 4 of refractory material are installed and secured, e.g. by bonding. Refractory material can, however, also be poured or cast into these recesses 3 and allowed to harden therein.

Figure 2:
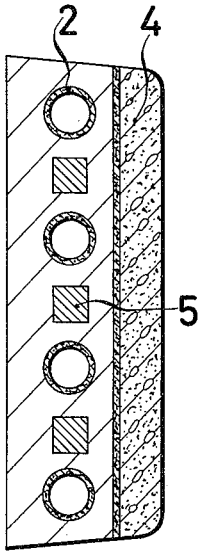
FIG. 2 is a section taken on line II—II of FIG. 1.

According to the present invention, temperature-absorbing bodies 5—here illustrated in form of 60 mm bars of rectangular cross section—are placed in the casting form intermediate the successive cooling tubes 2, as will be apparent from the sectional view in FIG. 2 of the finished cooling element. The casting form is now ready to effect casting of the actual body of the cooling element.

The elements or members 5 may have the following composition (expressed in weight percent)

| C | Si | Mn | P | S | Al |
|---|---|---|---|---|---|
| 0.15 | 0.20 | 0.70 | 0.020 | 0.020 | 0.050 |

the remainder being iron and the usual unavoidable contaminents.

To produce the body of the cooling element, a cast-steel melt is now poured into the casting form about the tubes 2 and the members 5. This melt has a composition of (expressed in weight percent)

| C | Si | Mn | P | S | Al |
|---|---|---|---|---|---|
| 0.23 | 0.45 | 0.91 | 0.010 | 0.019 | 0.037 |

the rest being iron and the usual unavoidable contaminents. A steel of this composition has a liquidous temperature of 1508° C. It is cast, however, at 1564° C., i.e. it is superheated above the liquidous point by 56° C., and the casting of the individual cooling element is carried out within a time period of less than three minutes, and in a concrete example of two minutes.

The combined volume of the members 5 in the concrete embodiment amounts of 1/15 of the overall volume of the body 6, which is the cast steel body produced by casting of the steel melt about the tubes 2 and the members 5. When such cooling elements were installed in metallurgical furnace walls, including in the walls of blast furnaces, and were subsequently examined after a prolonged period of use, it was found that neither the cooling elements themselves nor the steel tubes 2 had undergone any damage or destruction.

A particular advantage of the present invention resides in the fact that the cooling elements which can be produced according to the invention are relatively simple to produce and therefore inexpensive. Despite this, however, they have a significantly improved service life as compared to those which are known from the prior art. The problems which heretofore have been found to occur in prior-art cooling elements of this general type, namely decarborizing of the cooling element surface, cracks or fissures and localized melting of the cooling element, are no longer observed in cooling elements according to the present invention.

Of course, the embodiment illustrated and described with reference to FIGS. 1 and 2 is by way of example only and variations will offer themselves to those skilled in the art, including those which have been expressed at various points throughout the preceding description. All such variations are intended to be encompassed within the scope of protection of the appended claims.

We claim:

1. A cooling element for use in metallurgical furnaces, comprising a body of steel cast at a temperature above the liquidous point and having a surface adapted to face inwardly of the furnace; a pluralitiy of steel tubes embedded in said body and adapted to have cooling fluid circulated through them; and means embedded in said body spaced from said steel tubes and operative for absorbing, during the casting of said body, the temperature differential which arises between the casting temperature and the liquidous point; said means comprising steel members to absorb heat for preventing melting of said steel tubes during casting of said body; said steel tubes forming channels for conducting said cooling fluid, said steel tubes preventing development of cracks in walls of said channels from defects and cracks which may be present in said cast body.

2. A cooling element as defined in claim 1, wherein said body is cast at a temperature of substantially 30°–80° C. above liquidous temperature of the steel and within a time period shorter than three minutes, said cast steel body having a composition of 0.15 to 0.50% C.
0.30 to 0.80% Si
0.50 to 2.00% Mn
0 to 1.00% Mo
0 to 2.50% Cr the remainder being iron and unavoidable contaminents, said means containing carbon, manganese and silicon in amounts which are below the amounts of carbon, manganese and silicon contained in said steel body, said means comprising members having a combined volume equal to between 1/20 and 1/10 of the volume of said cast body.

3. A cooling element as defined in claim 1, wherein said means comprises members of cast steel.

4. A cooling element as defined in claim 1, wherein said means comprises members of the same material as said cast body.

5. A cooling element as defined in claim 1, wherein said means comprises members having a combined volume which is equal to between 1/20 to 1/10 of the volume of said cast body.

6. A cooling element as defined in claim 1, said means comprising bars of quadratic cross section which extend parallel to said steel cooling tubes.

7. A cooling element as defined in claim 1, said means comprising bars of rectangular cross section which extend parallel to said steel cooling tubes.

* * * * *